US006397391B2

(12) United States Patent
DeMarco

(10) Patent No.: US 6,397,391 B2
(45) **Date of Patent: *Jun. 4, 2002**

(54) REUSABLE STRAPLESS BACKLESS BRA

(75) Inventor: Jill R. DeMarco, 216 St. Antons Way, Arnold, MD (US) 21012

(73) Assignee: Jill R. DeMarco, Arnold, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/855,057

(22) Filed: May 14, 2001

Related U.S. Application Data

(63) Continuation of application No. 09/010,581, filed on Jan. 22, 1998, now Pat. No. 6,257,951.

(51) Int. Cl.[7] ..... A41C 3/00
(52) U.S. Cl. ..... 2/88; 2/8
(58) Field of Search ..... 450/53–57, 81, 450/86, 88, 79, 80, 82, 41–52; 2/73

(56) References Cited

U.S. PATENT DOCUMENTS

| | | | |
|---|---|---|---|
| 2,596,567 A | 5/1952 | Langs | |
| 2,664,571 A | 1/1954 | Kempel | |
| 2,728,079 A | 12/1955 | Williams | |
| 2,834,352 A | 5/1958 | Ullian | |
| 2,869,553 A | 1/1959 | D'Or | |
| 3,077,196 A | 2/1963 | Paxton | |
| 3,200,413 A | 8/1965 | Vaughan | |
| 3,221,748 A | 12/1965 | Glasser | |
| 3,280,818 A | 10/1966 | Pankey et al. | |
| 3,297,036 A | 1/1967 | Williams | |
| 3,556,107 A | 1/1971 | Brumfield | |
| 3,620,222 A | 11/1971 | Block | |
| 3,807,412 A | 4/1974 | Connelly | |
| 3,934,593 A | 1/1976 | Mellinger | |
| 4,143,424 A | 3/1979 | Knoke et al. | |
| 4,172,002 A | 10/1979 | Gluckin | |
| 4,245,644 A | 1/1981 | Evans | |
| 4,343,313 A | 8/1982 | LeJeune | |
| 4,372,321 A | 2/1983 | Robinson | |
| 4,386,990 A | 6/1983 | Gluckin | |
| 4,398,981 A | 8/1983 | Ellis | |
| 4,553,550 A | 11/1985 | Hattori | |
| 4,572,195 A | 2/1986 | Hyams | |
| 4,632,118 A | 12/1986 | Garutso | |
| 4,640,288 A | 2/1987 | Hattori | |
| D294,650 S | 3/1988 | DeBeys | |
| 4,770,650 A | 9/1988 | Rowell | |
| 4,816,004 A | 3/1989 | Emanuel | |
| 4,992,074 A | 2/1991 | Diaz | |
| 5,045,018 A | 9/1991 | Costanzo | |
| 5,071,433 A | 12/1991 | Naestoft et al. | |
| 5,098,330 A | 3/1992 | Greenberg | |
| 5,141,470 A | 8/1992 | Morgan et al. | |
| 5,388,273 A | 2/1995 | Sydor et al. | |
| 5,426,791 A | 6/1995 | Sydor et al. | |
| 5,472,366 A | 12/1995 | Moore | |
| 5,480,429 A | 1/1996 | Weber-Unger | |
| 5,527,202 A | 6/1996 | Morgan et al. | |
| 6,257,951 B1 * | 7/2001 | DeMarco | 450/55 |

* cited by examiner

*Primary Examiner*—Gloria M. Hale
(74) *Attorney, Agent, or Firm*—Lanier Ford Shaver & Payne; Anita S. Damian

(57) ABSTRACT

A reusable backless, strapless, one-piece bra. The bra comprises an underwire, a light-weight aluminum layer and a rubber foam layer, the light weight aluminum layer being positioned between foam rubber layers. The aluminum enables the bra to be molded to fit the contours of each person. The foam is bonded to the skin with double-sided, disposable dermal adhesive tape. The tape is applied horizontally across the bottom of the bra and attached to the rib cage just beneath the breast. A pad may be provided on an inner surface of-the bra to give the appearance of enhanced breast size.

2 Claims, 5 Drawing Sheets

REUSABLE STRAPLESS BACKLESS BRA

CROSS REFERENCE TO RELATED APPLICATION

This application is a continuation of U.S. application Ser. No. 09/010,581, filed on Jan. 22, 1998, U.S. Pat. No. 6,257,951.

FIELD OF THE INVENTION

This invention relates to a bra, and more particularly to a reusable strapless, backless bra.

BACKGROUND OF THE INVENTION

Strapless and backless bras are known in the art. However, none of the presently known strapless and backless bras provide a strapless, backless, one-piece bra having an underwire for improved support.

Also, known strapless, backless bras are not smooth and create an obvious appearance beneath clothing, or can give an asymmetrical appearance (e.g., a lack of conformity between the breasts).

Also, known strapless, backless bras do not provide a mechanism which allows the user to manipulate the bra to a personalized bra shape which will be maintained until re-shaping is desired.

Known strapless, backless bras are not properly structured to allow for freedom to enhance the appearance of breast size and shape.

The problems identified above are not intended to be exhaustive but rather are among many which tend to illustrate the need for an improved bra which allows a more aesthetically pleasing appearance. The above problems demonstrate that currently known solutions are amenable to worthwhile improvement.

SUMMARY OF THE INVENTION

Accordingly, it is a primary object of the invention to provide a strapless, backless bra which will obviate or minimize difficulties of the type previously described. One object of the present invention is to free a woman's shoulders and back of straps, thereby allowing women to have more freedom of fashion (e.g., halter tops, backless dresses, swimwear).

Another object of the invention is to eliminate lines so that beneath thin garments there is little evidence of an undergarment.

A further object of the invention is to provide conformity between both breasts, and to allow enhanced appearance of breast size and shape.

A further object of the invention is to provide at least one shaping mechanism which allows the user to manipulate the bra to a personalized bra shape which will be maintained by the shaping mechanism until re-shaping is desired.

A further object of the invention is to provide breast support that is firm, comfortable, breathable and pliable.

A further object of the invention is to provide a strapless, backless bra which is simple and cost-effective to manufacture.

In accordance with one aspect of the present invention, there is provided a pliable, strapless breast support including an integral member for supporting both breasts. The member comprises at least one pliable foam layer formed into two cups and having an inner surface which contacts the breasts during use, and at least one shaping mechanism in each cup.

The present invention also provides a method of making a pliable strapless bra which comprises forming a single pliable foam member into two cups for supporting breasts, and embedding at least one shaping mechanism into the foam.

The present invention further provides a method of using a pliable strapless bra having cups for supporting breasts. The method comprises forming a strapless bra of a pliable foam material, embedding at least one shaping element in the foam material, manually manipulating a shape of the bra by applying pressure to the shaping mechanism to obtain a desired support shape, wherein the shape is generally retained absent further manipulation, applying an adhesive strip to an inner surface of the bra, and adhering the bra to the rib cage such that the breasts fill the cups and are therefore supported by the strapless bra.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention, wherein.

DETAILED DESCRIPTION OF THE PREFERRED EMBODIMENTS

Figure 1:
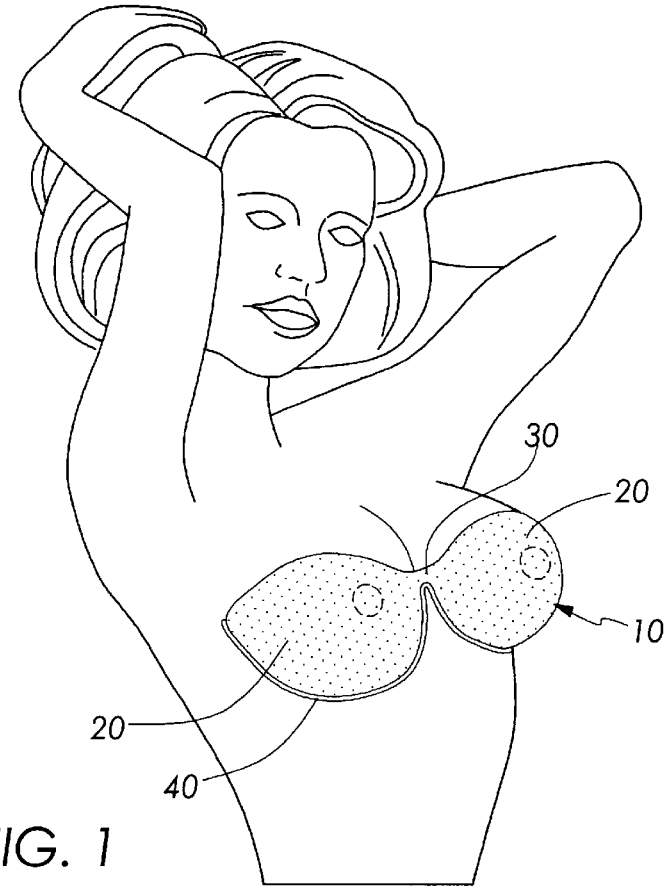
FIG. 1 is a view of the strapless, backless bra of the present invention illustrated in the manner in which it is worn.

In the figures, like numerals indicate like parts. FIG. 1 shows the strapless, backless bra 10 of the present invention illustrated in the manner in which it is worn. The bra includes two cups 20 connected at a bridge 30, and a flattened ridge 40 under the cups 20 which houses an underwire 50 (see FIG. 3*a*).

The bra comprises a medium to heavy strength underwire 50, rubber foam material forming the cups 20, a bridge 30, a fabric cover over the foam, disposable dermal adhesive tape, and at least one shaping mechanism (discussed below) in each cup.

The underwire will preferably be of flexible Delrin™ plastic custom-cut to provide moldable cup size and shape. The underwire 50 molds to the rib cage at a point underneath the breast and is covered with foam rubber to form the flattened ridge 40. In use, the flattened ridge will be held in place by being adhered to the rib cage, and will further be held in place by being folded between the breast and the rib cage.

The cups 20 extend outward and are graduated in thickness with the thinnest area being at the outer edges of the bra, where the foam material is feathered. This desirably eliminates visibility of the bra beneath thin garments so that there is little evidence of an undergarment.

Figure 2:
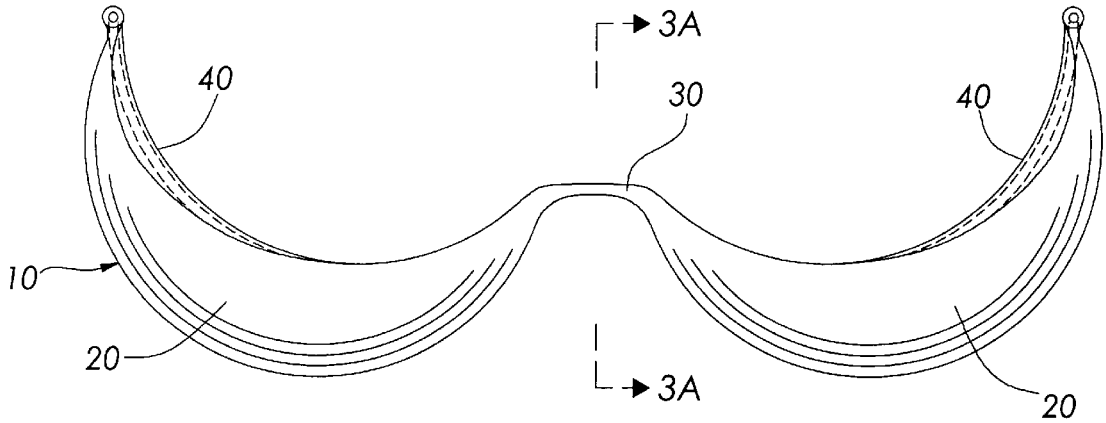
FIG. 2 is a bottom view of the bra of the present invention.
Figure 3A:
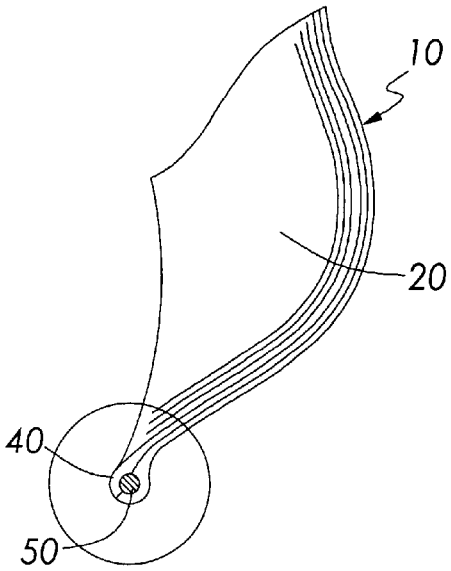
FIG. 3*a* is a cross-section of the bra taken along line 3*a*—3*a* of FIG. 2.
Figure 3B:
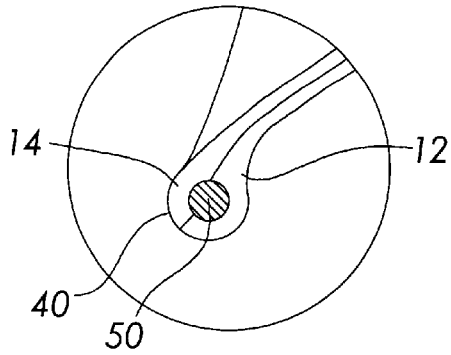
FIG. 3*b* is a close-up of the section indicated in FIG. 3*a;*

FIG. 2 shows a bottom view of the bra of the present invention. FIG. 3*a* is a cross-sectional view taken along line 3*a*—3*a* of FIG. 2. The bra 10 comprises-two layers 12,14 of non-irritant and non-toxic FDA-approved material for primary skin contact, is preferably a foam material. In a preferred embodiment, a flexible polyethylene foam is used. In a particularly preferred embodiment, Volara Type AS™ is used. A first shaping mechanism in the form of a standard underwire 50 is inserted between the two layers 12,14. FIG. 3*b* details placement of the underwire So between the layers 12,14. The underwire 50 preferably has a plastic tip 52 at each end (see FIG. 4). The layer/underwire assembly is heat pressed, at a temperature and pressure in accordance with the material used, to create a one-piece integral member. The edges of the one-piece integral member are feathered. For Volara Type AS™ material, heat pressing of the layers will occur at approximately 3000 lbs. Other alternatives to heat pressing include known thermoforming and molding processes.

Figure 4:
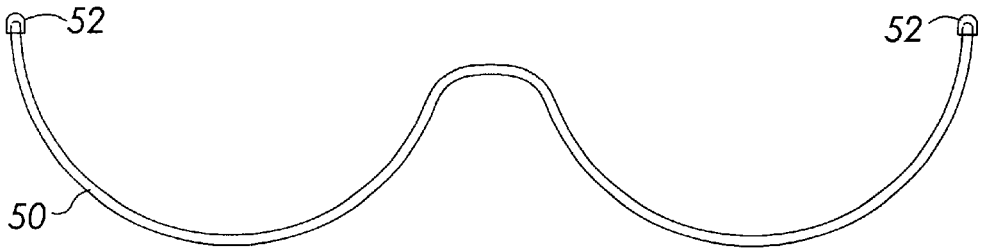
FIG. 4 illustrates a first shaping mechanism in the form of an underwire for a bra of the present invention.

FIG. 4 discloses an underwire 50 as used in the present invention, including the plastic tips 52 on each end of the underwire 50.

Figure 5:
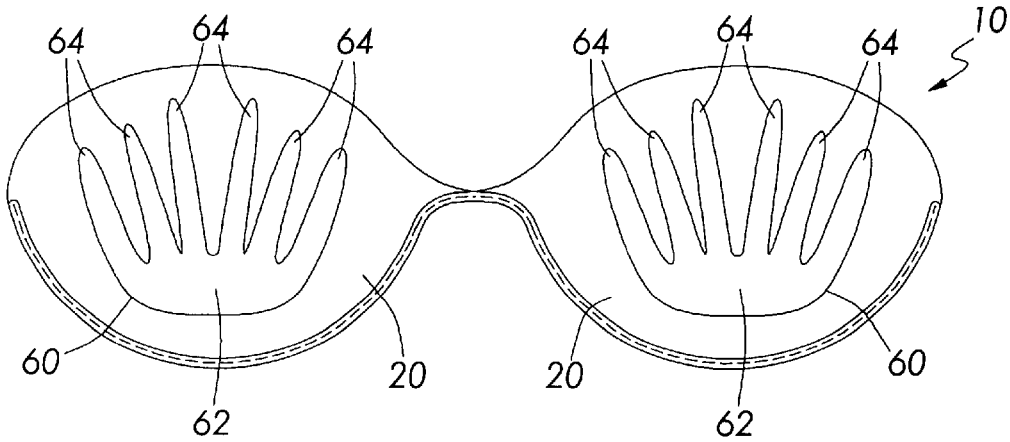
FIG. 5 is a view of the bra of the present invention which illustrates a first embodiment of a second shaping mechanism.

FIG. 5 shows a bra 10 of the present invention, including a first embodiment of the second shaping mechanism 60 embedded between the layers 12, 14 in each cup 20. The second shaping mechanism 60 includes a base 62 and a plurality of strips 64 extending from the base within the cup 20. Each shaping mechanism 60 covers a substantial portion of a cup 20 and comprises a material which can be manually manipulated to obtain a desired support shape for the bra 10 and retain the desired shape absent further manipulation. In a preferred embodiment, the shaping mechanisms 60 are formed of a thin aluminum material. In a particularly preferred embodiment, the material is 40 gauge aluminum.

Figure 6:
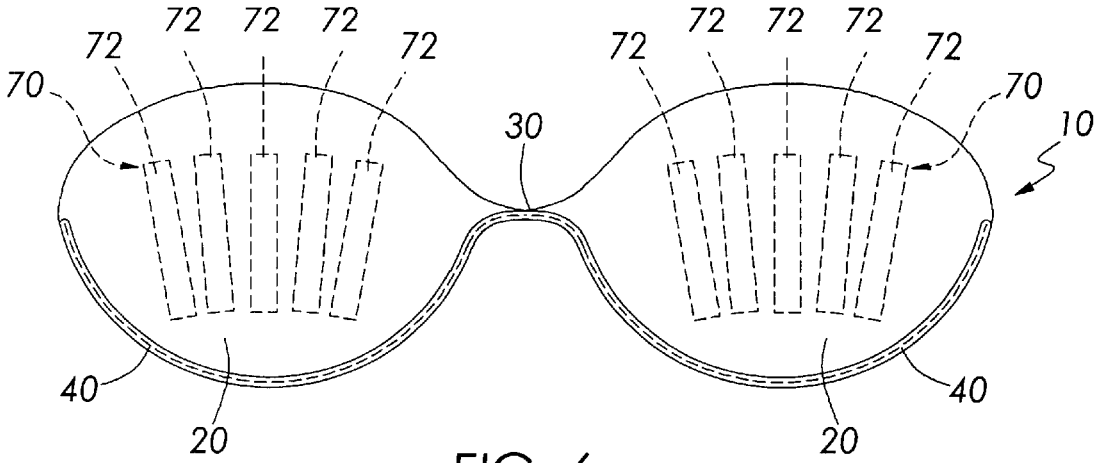
FIG. 6 is a view of the bra of the present invention which illustrates a second embodiment of the second shaping mechanism.

FIG. 6 shows a bra 10 of the present invention including a second embodiment of the second shaping mechanism 70 embedded between the layers 12, 14 in each cup 20. The second shaping mechanism 70 includes a plurality of strips 72 extending vertically within the cup 20, but may also extend horizontally. Each shaping mechanism 70 covers a substantial portion of a cup 20 and comprises a material which can be manually manipulated to obtain a desired support shape for the bra 10 and retain the desired shape absent further manipulation.

Figure 7:
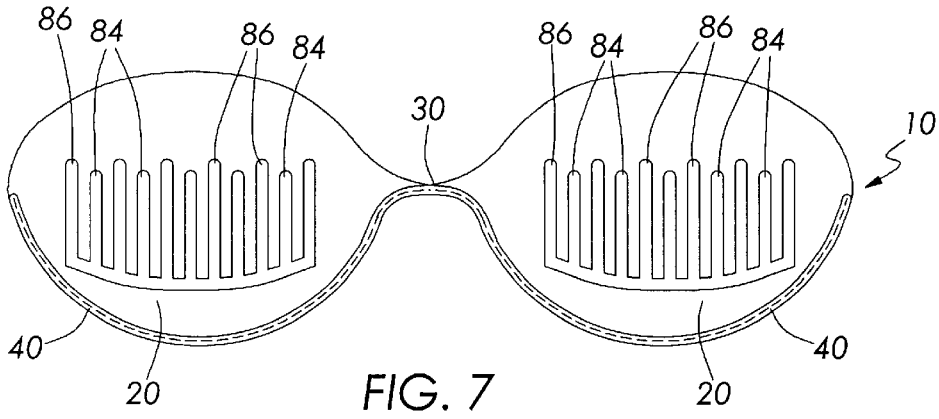
FIG. 7 is a view of the bra of the present invention which illustrates a third embodiment of the second shaping mechanism.

FIG. 7 shows a bra 10 of the present invention including a third embodiment of the second shaping mechanism 80 embedded between the layers 12, 14 in each cup 20. The second shaping mechanism 80 includes an arcuate base 82 and a plurality of alternating longer strips 84 and shorter strips 86 extending vertically within the cup 20. Each shaping mechanism 80 covers a substantial portion of a cup 20 and is formed of a material which can be manually manipulated to obtain a desired support shape for the bra 10 and retain the desired shape absent further manipulation. The second shaping mechanism preferably comprises a thin metal cut to resemble the desired shape. The second shaping mechanism more preferably comprises a thin aluminum as discussed above.

Figure 8:
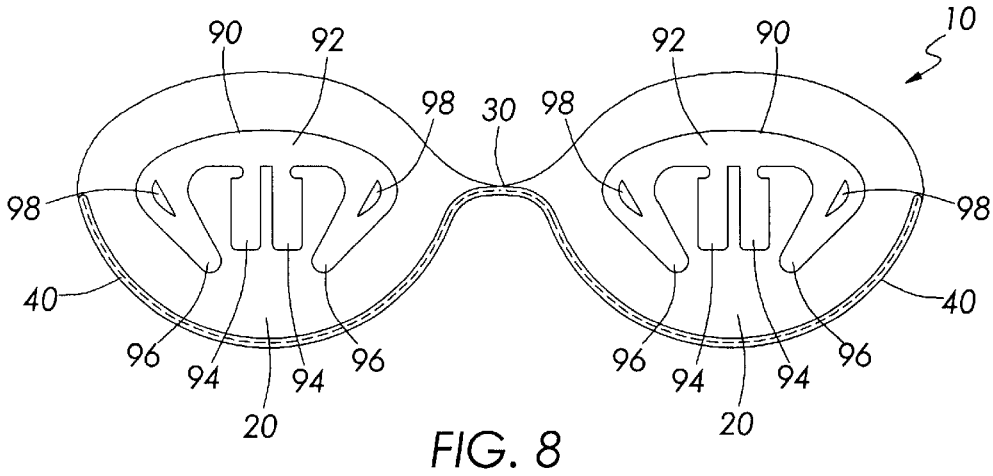
FIG. 8 is a view of the bra of the present invention which illustrates a fourth embodiment of the second shaping mechanism.

FIG. 8 shows a bra 10 of the present invention including a fourth embodiment of the second shaping mechanism 90 embedded between the layers 12, 14 in each cup 20. The second shaping mechanism 90 includes an arcuate base 92 and a pair of strips 94 extending vertically within the cup 20. Each end of the second shaping mechanism 90 is wedge-shaped and comes to a point 96. Within the wedge-shape is a cut-out portion 98. Each shaping mechanism 90 covers a substantial portion of a cup 20 and is formed of a material which can be manually manipulated to obtain a desired support shape for the bra 10 and retain the desired shape absent further manipulation. The second shaping mechanism preferably comprises a thin metal cut to resemble the desired shape and is preferably made of a thin aluminum as described above.

Figure 9:
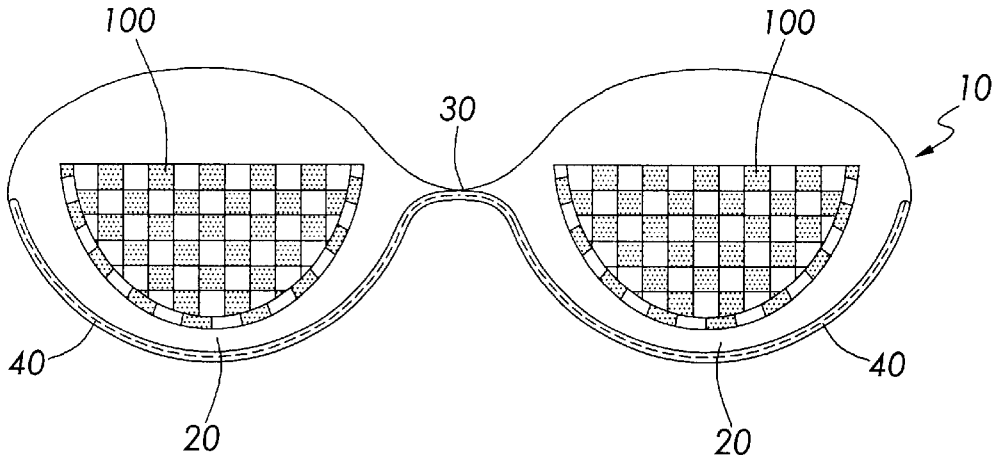
FIG. 9 is a view of the bra of the present invention which illustrates a fifth embodiment of the second shaping mechanism.

FIG. 9 shows a bra 10 of the present invention including a fifth embodiment of the second shaping mechanism 100 embedded between the layers 12, 14 in each cup 20. The second shaping mechanism 100 includes a semi-circular piece of thin metal which has been cut in a mesh-like pattern by cutting out alternating squares. The mesh-like pattern may also be achieved by cutting out a plurality of circles over the entire surface of a semi-circular piece of thin metal. The second shaping mechanism preferably is made of a thin aluminum as discussed above.

The second shaping mechanisms 60, 70, 80, 90, 100 ensure that the bra 10, whether or not it is on the wearer, will maintain its desired shape. Each wearer need only shape the bra 10 once and it will maintain its correct shape until the it is manipulated to another desired shape.

The second shaping mechanisms 60, 70, 80, 90, 100 are embedded between the layers 12,14 in much the same way as the underwire 50. Prior to heat-pressing the layers 12,14 together, the second shaping mechanism is inserted between the layers. After heat-pressing, both the second shaping mechanism and the underwire 50 are permanently embedded in the one-piece integral member. The second shaping mechanism allow the invention to be manipulated to fit the wearer's individual form.

A fabric cover (not shown) is laminated over the outer and inner exposed surfaces of the heat pressed layers 12, 14 of the bra 10 in order to create a more aesthetically pleasing appearance and to increase wearer comfort. The fabric cover can comprise any material suitable for undergarments, bathing suits and other types of clothing, and is preferably Lycra™ or cotton tricot and is flame laminated to the foam layers.

A dermal surgical pressure-sensitive adhesive is used to attach the bra to the body. A preferred embodiment of the pressure-sensitive adhesive includes a mixture of dioctyl phthalate, dibutyl succinate, diethyl azelate and Blenderm™. Blenderm™ is produced by 3M Corporation.

The pressure-sensitive adhesive is preferably a double-sided adhesive tape which is applied directly along an inside surface of at least the flattened ridge 40 of the bra 10. Depending on the preference of the wearer, the adhesive can also be applied to the inner surface of each cup as needed. The double-sided adhesive will preferably have tape backing on both sides and will be sold in pre-measured shapes to fit the curve of the base and the interior of each cup. To apply the adhesive, a first backing is removed and the tape is smoothed onto the base of the bra. The second backing is then removed and the bra with its exposed adhesive is placed on the wearer's rib cage directly beneath the breast (and on the wearer's breasts if adhesive is placed in the cups) as the wearer leans forward slightly. The bra is then held in place for approximately 10–15 seconds to allow the adhesive to satisfactorily bond with the skin. Additional layers of adhesive can be applied for subsequent uses of the bra.

Figure 10:
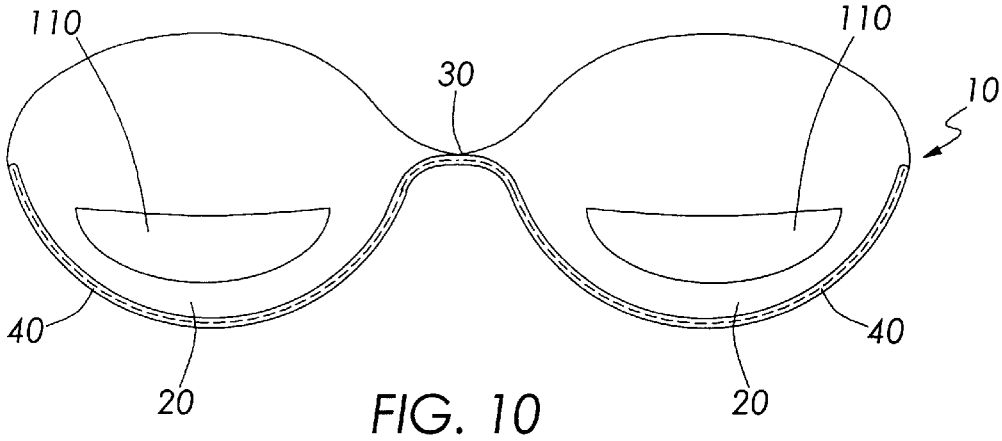
FIG. 10 illustrates positioning of a shape-enhancing pad on an inner surface of the bra of the present invention.

FIG. 10 discloses placement of optional shape-enhancing pads 110 on a lower inner surface of each cup 20 of the bra 10 of the present invention. The pads do not cover the entire cup, but rather fill the area beneath the nipple. The pads are therefore undetectable. The pads increase comfort by allowing air to remain between the breast and the foam rubber.

The shape-enhancing pads 110 are preferably cut in a semi-circular shape. The thickness of the shape-enhancing pads 110 can vary depending on the amount of shape enhancement desired by the wearer. The thicker the shape-enhancing pad, the larger and fuller the wearer's breast will appear upon placement of the pad onto the inner surface of the bra 10. Each shape-enhancing pad 110 comprises a soft and absorbent material, preferably paper, foam, or a nylon blend.

The shape-enhancing pads 110 can be held in place on the lower, inner surface of each cup 20 by using an adhesive, by creating pockets in the fabric cover to accommodate the pads, or by an other suitable means to hold them in place.

Other embodiments of the reusable strapless, backless bra will be apparent to those skilled in the art from consideration of the specification disclosed herein. For example, the bra can be used as swimwear, thus allowing the wearer to avoid unwanted tan lines. It is intended that the specification be considered as exemplary only, with the true scope and spirit of the invention being indicated by the following claims.

What is claimed is:

1. A backless breast support apparatus, said apparatus comprising:

at least one foam layer constructed and arranged to form two cups, said at least one foam layer including an inner surface which abuts the breasts during use; and at least one underwire cooperating with said at least one foam layer to support each breast when that apparatus is worn by a user, wherein the inner surface of said foam layer is adapted to receive an adhesive strip for adhering said apparatus to the skin of a user adjacent the user's rib cage.

2. A method of supporting breasts, said method comprising the steps of:

positioning a backless bra over the breasts of a user, said backless bra comprising a shaping mechanism and a foam layer, said shaping mechanism and said foam layer constructed and arranged to form two cups;

manually manipulating said backless bra such that each breast is supported by each cup;

exposing an adhesive material affixed to each cup; and adhering the adhesive material to the skin of a user adjacent the rib cage to substantially maintain the position of each cup with respect to each breast.

* * * * *